US009518395B2

(12) United States Patent
Kuijper

(10) Patent No.: US 9,518,395 B2
(45) Date of Patent: Dec. 13, 2016

(54) ARRANGEMENT FOR FORMING A FLOOR COVERING

(71) Applicant: Kuijper Modell—und Formenbau GmbH, Goldach (CH)

(72) Inventor: Ivo Kuijper, Rorschacherberg (CH)

(73) Assignee: KUIJPER MODELL-UND FORMENBAU GMBH, Goldach (CH)

( * ) Notice: Subject to any disclaimer, the term of this patent is extended or adjusted under 35 U.S.C. 154(b) by 0 days.

(21) Appl. No.: 14/624,869

(22) Filed: Feb. 18, 2015

(65) Prior Publication Data

US 2015/0368911 A1 Dec. 24, 2015

(30) Foreign Application Priority Data

Jun. 20, 2014 (EP) ..... 14002122

(51) Int. Cl.

| | |
|---|---|
| ***E04F 15/02*** | (2006.01) |
| ***E04F 13/08*** | (2006.01) |
| ***E04F 13/18*** | (2006.01) |
| ***E04F 15/04*** | (2006.01) |
| ***E04F 15/10*** | (2006.01) |

(52) U.S. Cl.

CPC ..... *E04F 15/02044* (2013.01); *E04F 13/0805* (2013.01); *E04F 13/0819* (2013.01); *E04F 13/18* (2013.01); *E04F 15/04* (2013.01); *E04F 15/105* (2013.01); *E04F 2015/02061* (2013.01); *E04F 2015/02072* (2013.01)

(58) Field of Classification Search

CPC ..... E04F 15/02044; E04F 2015/0205; E04F 2015/02055; E04F 2015/02061; E04F 2015/02066; E04F 2015/02072; E04F 2015/021; E04F 13/0805; E04F 13/0807; E04F 13/808

See application file for complete search history.

(56) References Cited

U.S. PATENT DOCUMENTS 3,308,588 A * 3/1967 Von Wedel ..... E04B 1/6112 52/127.8
3,745,736 A * 7/1973 Fischer ..... A63H 33/062 29/453
6,286,272 B1 9/2001 Sandoz
(Continued)

FOREIGN PATENT DOCUMENTS

DE 4016939 A1 11/1991
DE 10150889 4/2003
(Continued)

OTHER PUBLICATIONS

Press Release, 1 pg. plus translation (issued Jul. 2, 2013).
(Continued)

*Primary Examiner* — Elizabeth A Quast
(74) *Attorney, Agent, or Firm* — Volpe and Koenig, P.C.

(57) ABSTRACT

An arrangement for forming a floor covering (1), wall covering or ceiling covering having a substructure (2) and at least one covering element (4) fastened to the substructure (2) by at least one latching connection (3), the latching connection (3) being configured as a nondestructively detachable and re-connectable latching connection (3) in order to take the covering element (4) off the substructure (3) and subsequently re-fasten the covering element (4) to the substructure (2).

17 Claims, 6 Drawing Sheets

(56) References Cited

U.S. PATENT DOCUMENTS

| | | | | |
|---|---|---|---|---|
| 6,301,842 | B1 * | 10/2001 | Chaney | E04B 5/12 52/177 |
| 7,648,407 | B1 * | 1/2010 | Sorensen | A63H 33/084 446/120 |
| 2006/0156664 | A1 * | 7/2006 | Chae | E04F 13/0814 52/480 |
| 2009/0094925 | A1 | 4/2009 | Andres et al. | |
| 2015/0075111 | A1 * | 3/2015 | Claudin | E04F 15/02044 52/708 |

FOREIGN PATENT DOCUMENTS

| | | | |
|---|---|---|---|
| DE | 202007002282 | U1 | 6/2008 |
| DE | 202009007507 | U1 | 9/2009 |
| DE | 202011106654 | U1 | 6/2012 |
| DE | 202012003999 | U1 | 8/2012 |
| EP | 0133868 | | 3/1985 |
| EP | 0149770 | | 7/1985 |
| EP | 1691002 | A2 | 8/2006 |
| NL | 1005401 | | 8/1998 |
| WO | 2006011173 | | 2/2006 |

OTHER PUBLICATIONS

Profile Picture, 1 pg., undated, believed to be available prior to Jun. 20, 2014.

Profile Advertisement, 1 pg., undated, believed to be available prior to Jun. 20, 2014.

* cited by examiner

ARRANGEMENT FOR FORMING A FLOOR COVERING

INCORPORATION BY REFERENCE

The following documents are incorporated herein by reference as if fully set forth: European Application No. 14 002 122.1, filed Jun. 20, 2014.

BACKGROUND

The present invention relates to an arrangement for forming a floor covering, wall covering or ceiling covering having a substructure and at least one covering element fastened to the substructure by means of at least one latching connection. Furthermore, the invention also relates to a method for the assembly of a floor covering, wall covering or ceiling covering having a substructure and at least one covering element that is fastenable to the substructure by means of at least one latching connection.

In the prior art, in order to form a floor covering, wall covering or ceiling covering, the covering elements, which may be in the form for example of boards, planks or the like, are frequently screwed onto a substructure made of wood. This is not only time-consuming but also has the disadvantage that the screw heads can still be seen after completion of the assembly. In order to avoid these problems, it is already known to fasten covering elements to the substructure by means of latching connections. These latching connections, as are shown for example in DE 101 50 889 A1, US 2009/0094925 A1 and also in WO 2006/011173 A1, always have a type of barb in the prior art in order to avoid the covering element detaching from the substructure.

In the prior art, the covering elements are usually fastened to the substructure such that an air gap still remains between adjacent covering elements. In the case of covering elements made of wood, this primarily has the object of allowing moisture- and temperature-related swelling and shrinking of the material. In the case of covering elements made of some other material, for example plastics material, corresponding clearances are made for back ventilation or else for visual reasons or optionally also for compensating for temperature-related expansions and contractions.

The disadvantage of the intermediate spaces between the covering elements is that dirt and, especially in the outdoor area, also rotting material such as leaves, flowers and the like can fall through these intermediate spaces into the region of the substructure beneath the covering element or covering elements. Over the years, an accumulation of dirt and possibly also a rotting process then occurs in the region of the substructure beneath the covering elements. In order to be able to clear these undesired deposits, it is necessary in the prior art to remove the entire floor, wall or ceiling covering and subsequently completely refit it again. The material of the previous floor, wall or ceiling covering can then usually no longer be used or can only be used in part for this refitting.

SUMMARY

It is the object of the invention here to provide an improvement which reduces the effort that is necessary in order to remove said undesired deposits from the region of the substructure.

In the case of an arrangement according to the invention, provision is made to this end for the latching connection to be configured as a nondestructively detachable and re-connectable latching connection in order to take the covering element off the substructure and subsequently re-fasten the covering element to the substructure. A method according to the invention provides for the substructure and the covering element to be constituent parts of an arrangement according to the invention, and for the covering element to be fastened to the substructure in a nondestructively detachable manner by means of the latching connection.

In contrast to the abovementioned prior art, in which attempts are always made to form the latching connection such that it can no longer be detached, the invention thus goes in exactly the opposite direction. It forms the latching connection such that the covering element can be detached nondestructively from the substructure again and subsequently be connected to the substructure again via the latching connection. As a result, it is possible, by detaching the latching connections, to take the covering elements off the substructure, to remove the abovementioned undesired deposits in the region of the substructure, and subsequently to connect the covering elements to the substructure again by means of the latching connection. This can be carried out multiple times without the arrangement or latching connection according to the invention being destroyed in the process. The removal of the undesired deposits in the region of the substructure can thus be carried out without a completely or partially new floor, wall or ceiling covering having to be subsequently fitted. In addition to the fact that arrangements according to the invention can be used both as floor, wall or ceiling coverings in the indoor and outdoor area of a building, it should also be noted that the arrangement according to the invention is suitable in particular for the outdoor area in order to form terrace coverings and the like.

The covering elements can in principle have a wide variety of forms, for example be configured in the form of boards. The covering elements are particularly preferably configured in the form of boards or planks. This means that their length is preferably much greater than their width and height. The covering elements can be produced from different materials. These may be wood, composite wood, various plastics materials or else composite materials. The entire range of materials that are known in the prior art for such covering elements come into question here. The covering element is preferably in each case that part of the arrangement which forms the visible element of the floor covering, wall covering or ceiling covering in the finally assembled state. The latching connection could also be designated snap-action connection. In addition to the fact that the region of the substructure can be cleaned with relatively little effort, the invention generally also has the advantage that, by means of the nondestructively detachable and re-connectable latching connections, very easy and quick, and optionally even tool-less assembly of the floor, wall or ceiling covering is possible. Replacing individual covering elements is also easily possible. In principle, according to the invention, the covering elements can be detachably fastened to the substructure with different intermediate spaces or without any intermediate spaces at all.

Particularly preferred embodiments of the invention provide for the latching connection to engage in a nondestructive manner by the covering element being pressed against the substructure in a direction toward the substructure, and to disengage in a nondestructive manner by the covering element being lifted off the substructure in a direction away from the substructure. Pressing on and lifting off in this case take place in preferred embodiments in directions parallel to the normal to the substructure.

The latching connection can in principle be embodied in a wide variety of manners. It can even be magnetic latching connections or the like. In principle, in the prior art, many different types of nondestructively detachable and re-connectable latching connections are known, and these can in principle be used in order to realize the invention. However, particularly preferred types of configuration of the invention provide for the latching connection to have at least one latching head and at least one latching receptacle, the latching head engaging in a form-fitting manner behind at least one undercut in the latching receptacle in the engaged state of the latching connection. In this case, provision can be made for the latching head and/or the latching receptacle to be elastically deformable in order to engage and/or disengage the latching connection. The elasticity that may be necessary for this can be realized by an appropriate selection of material for the latching head and also for the latching receptacle. However, it is also quite possible to provide notches in the latching head and/or in the latching receptacle in order to form or to improve the elastic deformability. In order to make nondestructive engagement and/or disengagement of the latching connections easier, preferred variants provide for the latching head and/or the latching receptacle to have inclined faces and/or rounded contours in order to make it easier to engage and/or disengage the latching connection. The inclined faces are in this case conveniently oriented obliquely to the directions in which the covering element is pressed onto the substructure during assembly and is lifted off the substructure during disassembly. The same goes for the rounded contours. For this purpose, a person skilled in the art will find many different specific embodiments of inclined faces and/or rounded contours which make nondestructive engagement and/or disengagement easier. In the invention, the latching head and latching receptacle preferably have mutually corresponding shapes which allow nondestructive detachment and connection of the latching connections. For example, provision can be made for the latching head and/or the latching receptacle to have at least regionally, in at least one cross section, a contour which is preferably circular, rounded and extends through an angular range of more than 180°.

Since the parts of the latching connection that are located on the covering element are usually located on the not directly visible rear side of the covering element during the assembly of the covering element on the substructure, provision is preferably made for the latching receptacle to be found as easily as possible with the latching head. For this purpose, preferred variants provide for the latching receptacle to be a longitudinally extended groove. Particularly preferred variants of this type then provide for the latching head to be shorter than the latching receptacle in the direction of longitudinal extent of the latching receptacle. This is of course also realizable the other way round.

The substructure can in principle be formed in very different manners. Provision can be made for the latching heads to be fastened to the substructure and the latching receptacles to the covering element. The reverse variant is just as easily possible, however. Of course, this also goes for all other types of nondestructively detachable and re-connectable latching connections that are usable according to the invention.

Preferred embodiments of the invention provide for the substructure to have at least one profile rail in or on which the latching head or the latching receptacle is arranged, preferably so as to be displaceable along the profile rail. Of course, the latching heads and or latching receptacles can also be fixed. The profile rails can in this case rest on supporting elements. In order to carry out leveling and height adjustment, provision is particularly preferably made for the bearing elements to be able to be composed of different bearing element parts. The bearing element parts or bearing elements may be plate-like components. For the purpose of quick assembly, the bearing element parts can be pluggable together for example by frictional or form-fitting connecting elements and/or have a plate-like basic shape. At least the topmost bearing element part that is directed toward the profile rail should have a connecting element, in particular a connecting head, in order to fasten the entire bearing element to the profile rail. To this end, provision can be made for example for the profile rail to have one or more undercut grooves into which the connecting head can engage in a form-fitting manner. The profile rails may be metal, plastics or wooden rails. Preferably, extruded profiles that are known per se, for example extruded profiles made of aluminum, are used as profile rails. Other metal rails are also possible, of course. Apart from optionally rounded corners and the undercut grooves, the profile rails can have a rectangular or square shape in cross section. The latching heads, but also the latching receptacles, can be fastened to carriers which can be pushed into an undercut groove of the profiles. Such a carrier can have one, two or more latching heads and/or latching receptacles, wherein the carrier can then automatically define or fix the spacing between two adjacent latching heads and/or latching receptacles, thereby making it easier to assemble the covering elements at a constant spacing apart on the substructure.

Preferred embodiments of the invention provide for in each case one part of at least two of the latching connections to be arranged on a common carrier and for these parts of the latching connections to be spaced apart from one another. The carrier can in this case be formed in one piece with the corresponding parts of the latching connections. However, the parts of the latching connections can also be fastened to the common carrier in some other way. The carrier and the parts of the latching connections can be made for example of plastics material. Injection-molded production would be appropriate. Provision is preferably made for the carrier to be or to be able to be arranged in or on a profile rail of the substructure, preferably in an undercut groove of the profile rail, so as to be displaceable along the profile rail. As already explained at the beginning, for example moisture- or temperature-related swelling or shrinking occurs in various covering elements according to the prior art. As a result, a change in length and/or width of the covering element itself, but also a change in the geometry, in particular in the spacing between at least two covering elements, can occur. In the prior art, this cannot generally be compensated, and so breaking, cracking or buckling of the covering elements or of the substructure can occur. In order to allow such changes in the length and/or width of a covering element or of the covering elements and/or in the orientation of the covering elements relative to one another to occur without unnecessary stresses occurring as a result, particularly preferred variants of an arrangement according to the invention provide for at least one compensation region for making it possible to change the spacing between the parts of the latching connections to be arranged in the carrier and/or between the carrier and at least one of the parts of the latching connections. The parts of the latching connections can be for example latching heads or latching receptacles. The compensation region can be located in a section of the carrier between the parts of the latching connections or else directly between at least one of the parts of at least one of the latching connections and the carrier. For example, the carrier could have two carrier sections which are mounted so as to be displaceable relative to one another and on which for example in each case a part of one of the latching connections is then arranged, in particular fixed. It would be just as possible for a part of at least one of the latching connections to be mounted in a displaceable manner in or on the carrier. Particularly preferred embodiments of the compensation region provide for it to be a thinning of material in the carrier. For example, the carrier can have one or more bending limbs, optionally connected together via bending joints, in the compensation region. Provision can be made for two bending limbs to be arranged in a V-shaped manner in the compensation region. The compensation region can be embodied in an elastically deformable manner. However, this is not absolutely necessary. It may just as easily be two sections of the carrier, or of the carrier and at least one part of one of the latching connections, that are mounted on one another in a displaceable manner with respect to one another, without these components being elastically deformable.

In particular in those variants in which the carrier is arranged in or on a profile rail so as to be displaceable along the profile rail, preferred embodiments provide for at least one pretensioning element, for example in the form of a spring tongue or the like, to be arranged on the carrier. By way of this pretensioning element, the carrier can press against a profile rail such that it is displaceable along the profile rail only when a degree of friction is overcome. This can make it easier to preposition the carriers and thus the parts of the latching connections on the substructure during assembly of the covering elements.

A preferred method for compensating for changes in the length and/or width of a covering element and/or in the orientation of at least two covering elements relative to one another in an arrangement according to the invention provides for the spacing to be varied in the compensation region.

BRIEF DESCRIPTION OF THE DRAWINGS

Further features and details of preferred embodiments of the invention are explained in the following text using examples that are selected by way of example. In the drawings.

DETAILED DESCRIPTION OF THE PREFERRED EMBODIMENTS

Figure 1:
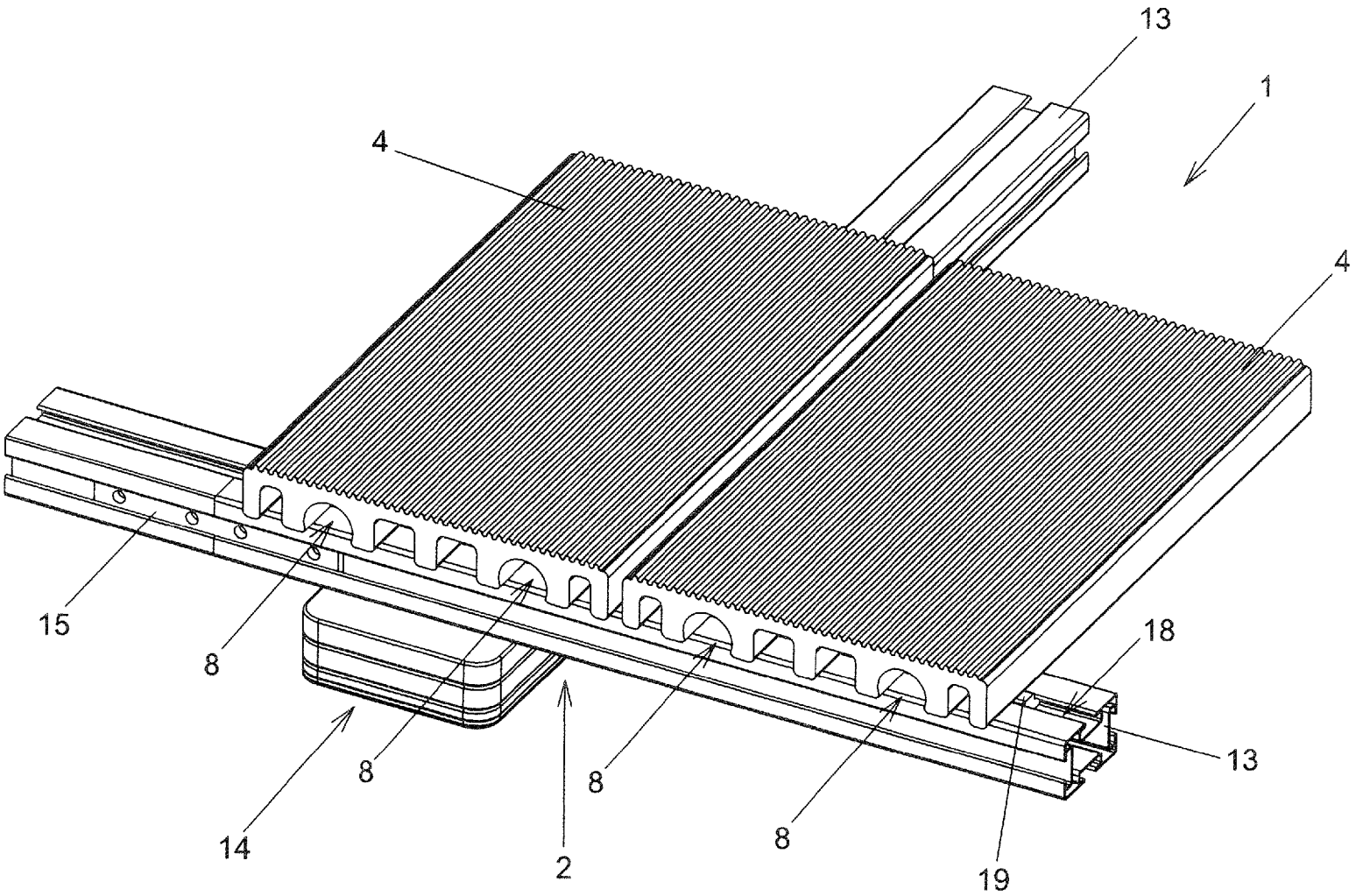
FIG. 1 shows a perspective view obliquely from above of a selectively illustrated region of a disclosed floor covering arrangement.
Figure 2:
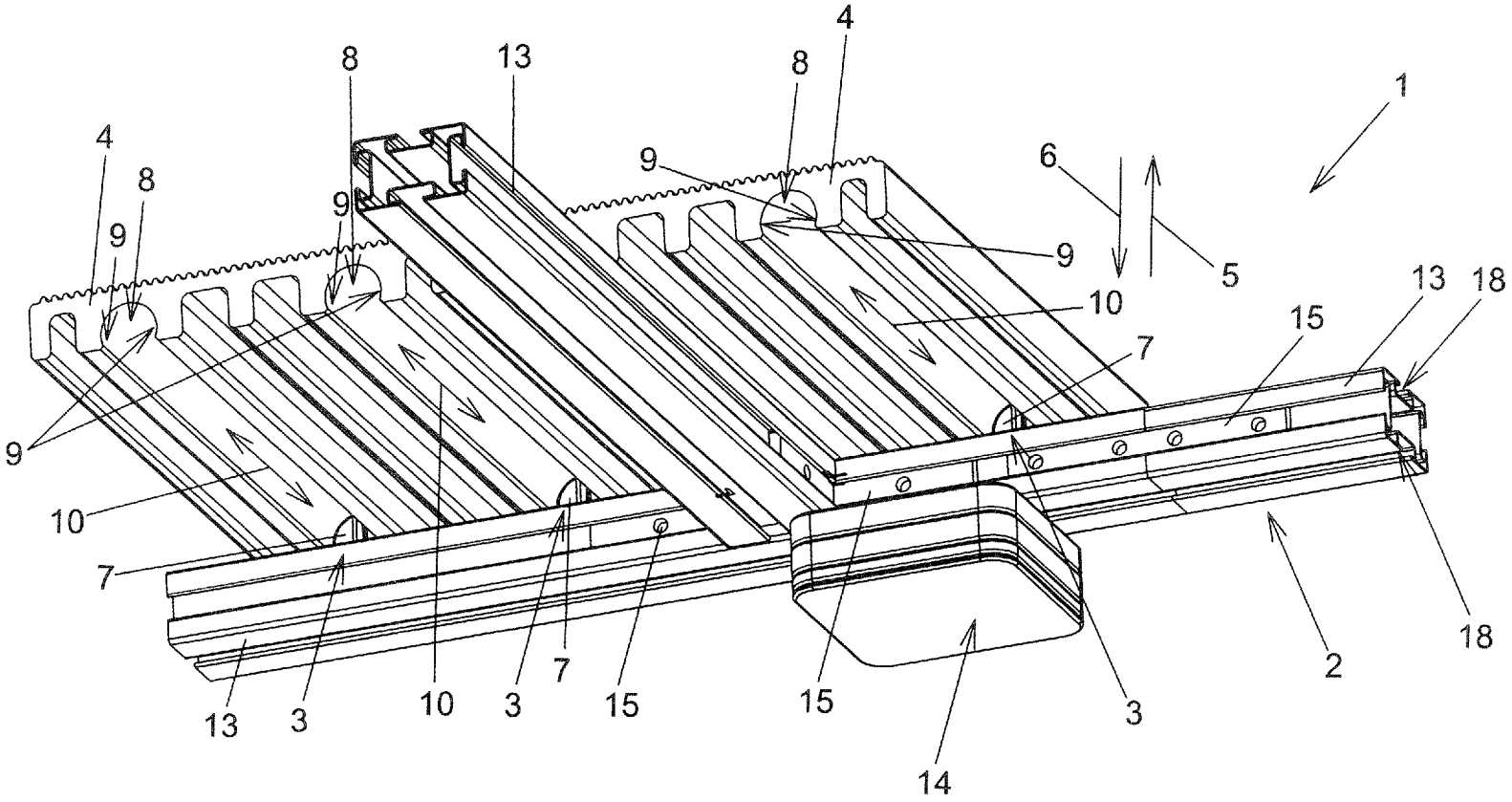
FIG. 2 shows a perspective view obliquely from below of a selectively illustrated region of the floor covering arrangement of FIG. 1.

FIGS. 1 and 2 illustrate a small part of the overall structure of the first exemplary embodiment of an arrangement according to the invention in the form of a floor covering 1. The manner in which two covering elements 4, which are illustrated in a shortened manner, are fastened to the substructure 2 by means of the latching connection 3 that is nondestructively detachable and re-connectable according to the invention, is shown. In the exemplary embodiment shown, the substructure 2 comprises a frame formed from profile rails 13, said frame resting on the bearing elements 14, which are in each case of multipart construction. The frame formed from the profile rails 13 is supported on the underlying surface, which is not illustrated separately here, by means of the bearing elements 14. When the covering 1 is used as a wall or ceiling covering on a corresponding building wall or building ceiling, the bearing elements 14 are fastened to the wall or ceiling in a corresponding manner for example by way of screw-connection or the like. The profile rails 13 are preferably extruded profiles, for example made of aluminum, as also realized in the exemplary embodiment shown here. The profile rails 13 of this exemplary embodiment have undercut grooves 18. The connecting head 17 of the bearing element 14 engages in one of these grooves 18 in order to fasten said bearing element to the profile rail 13. The carrier 19, having two latching heads 7 here, has been pushed into the opposite undercut groove 18 of the profile rail 13. In the first exemplary embodiment shown, the latching heads 7 are one part of the latching connection. The other, corresponding part of the latching connection consists of the latching receptacles 8, which are formed integrally in the underside of the covering element 4 here as longitudinally extended grooves. The latching receptacles 8 could of course also be fastened to the covering element 4 in some other way as separate parts. As in the exemplary embodiment shown, each covering element 4 has two such latching receptacles 8 in the form of longitudinally extended grooves. The latching receptacles 8 extend parallel to one another. FIG. 1 shows the view of the floor covering 1 in perspective from above, and FIG. 2 shows the view in perspective from below. The direction 10 of the longitudinal extent of the latching receptacles 8 is indicated in FIG. 2, as are the undercuts 9, behind which the latching heads 7 engage in the engaged state. FIG. 2 also shows how the profile rails 13 are connected together by means of the connecting plates 15 in order to form a corresponding frame. The connecting plates 15 can be formed in a straight or angled manner, depending on the direction in which the profile rails 13 to be connected together are intended to be oriented relative to one another. In the exemplary embodiment shown, the covering elements 4 are engaged by way of their latching receptacles 8 with the latching heads 7 connected to the substructure 2 by the covering element 4 being pressed onto the substructure 2 in the direction 5. The nondestructive disengagement of the latching connection takes place by the covering element being lifted off the substructure 2 in the direction 6. In the preferred exemplary embodiment shown, the directions 5 and 6 are normal to the substructure. Of course, other angles are also possible here.

Figure 3:
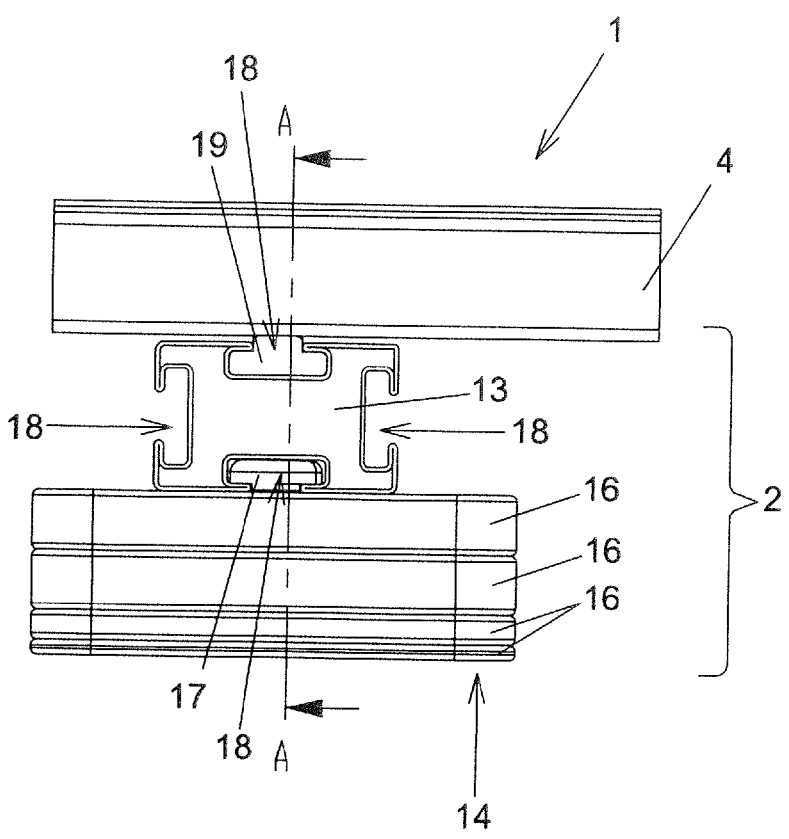
FIG. 3 shows a side view of the floor covering arrangement of FIGS. 1-2.

FIG. 3 clearly shows how the profile rail 13 is supported on the bearing element 4 and the connecting head 17 of the bearing element 14 engages in a form-fitting manner in the lower groove of the profile rail 13. It can furthermore be clearly seen that, as provided in preferred embodiments, the bearing element 14 is of multipart construction. Specifically, this consists of a number of bearing element parts 16 which are located one on top of another and are connected together preferably in a frictional or form-fitting manner and form the bearing element 14 as a stack. The bearing element parts 16 can, as realized here, have different thicknesses and be provided in a standardized manner with corresponding connecting devices in order that an appropriate number and thickness of bearing element parts can be plugged together easily on site in order to compensate for irregularities and can be used as bearing element 14 at the corresponding point. FIG. 3 also clearly shows that the carrier 19, to which the latching heads 7 are fastened in this exemplary embodiment, is located in the upper undercut groove 18 of the profile rail 13. In principle, the carrier 19 can be embodied in one piece with one or more latching heads 7. It is just as possible for one or more latching receptacles 18 to be located on a carrier. Here too, a one-piece form is possible. In the various embodiments, these can be for example injection-molded plastics parts. Of course, the carrier and latching head or latching receptacle can also be constructed in a multipart manner, that is to say from a number of parts, and can also be produced for example from metal or wood, as long as the appropriately elastic properties result therefrom.

The covering element 4, which is supported by means of the latching connection on the substructure and in this case specifically on the profile rail 13, is fastened to the substructure or the profile rail 13 by means of the latching connection.

Figure 4:
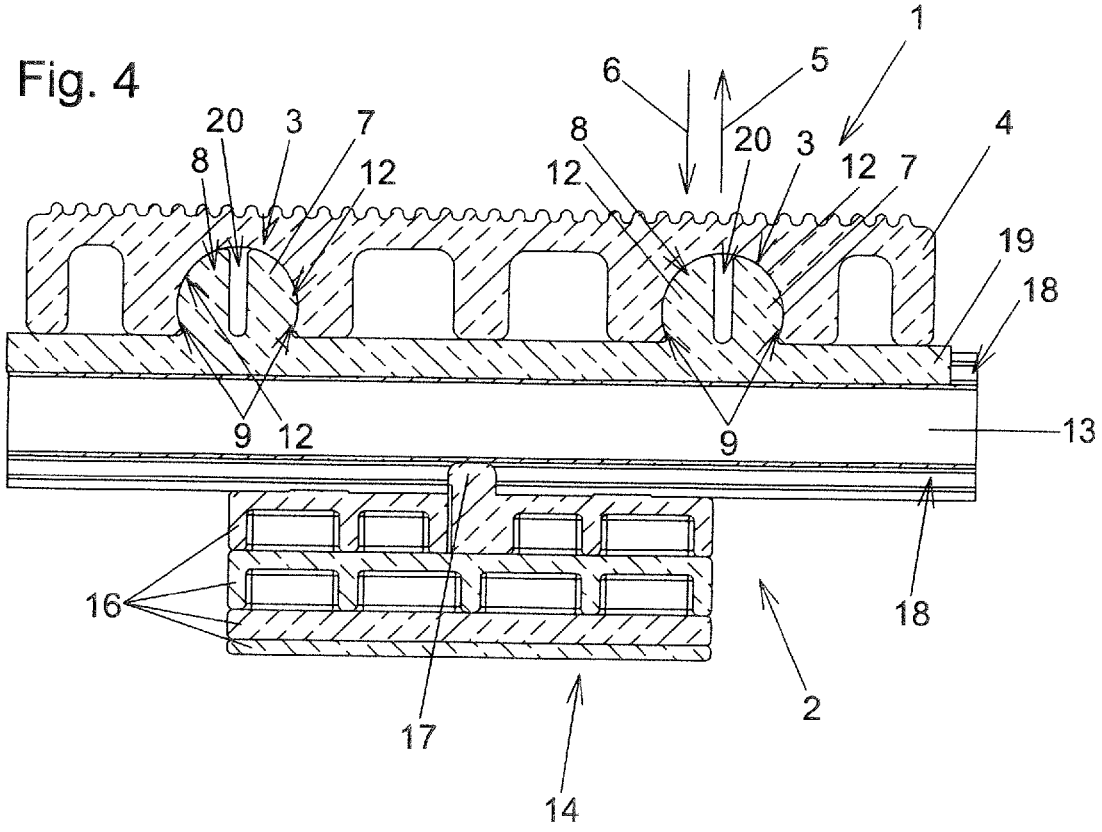
FIG. 4 shows a section view along the section line A-A in FIG. 3.

FIG. 4 shows the section along the section line A-A in FIG. 3. The multipart construction of the bearing element 14 can be readily seen once again here. In this sectional illustration, the shape of the latching heads 7 and the corresponding shape of the latching receptacles 8 are also illustrated for the first time. In the first exemplary embodiment, both the latching head 7 and the latching receptacle 8 have at least regionally, in the cross section shown, a contour 12 which is in this case circular and rounded. This contour extends in each case through an angular range of more than 180° in order to form the undercut 9 of the latching receptacle 8 and the corresponding engagement of the latching head 7. In order to improve the elasticity in the latching head 7, in each case one gap 20 is provided in the latching head 7 in the exemplary embodiment shown. This is only an example for the fact that one or more such gaps can be present in the latching head 7 and/or in the latching receptacle 8 in order to improve the elasticity of said components.

In the variant shown, a carrier 19, which has in this case been pushed into the groove 18 of the profile rail 13, carries two latching heads 7 with which in this case two latching receptacles 8 of a covering element 4 engage. Of course, it is also possible for more than two latching heads 7 or only one latching head 7 to be provided on the carrier 19. In the case of two or more latching heads 7 on a carrier 19, this can also be used, unlike in the exemplary embodiment shown here, in order that two adjacent covering elements 4 are connected together by means of a single carrier 19, as a result of which the spacing between the adjacent covering elements 4 is then automatically fixed.

With the rounded contour 12 of the latching head 7 and latching receptacle 8 and also the overall elastic form of these components, the nondestructively detachable and re-connectable configuration of the latching connection 3, as provided according to the invention, is achieved in any case in the exemplary embodiment shown here.

Figure 5:
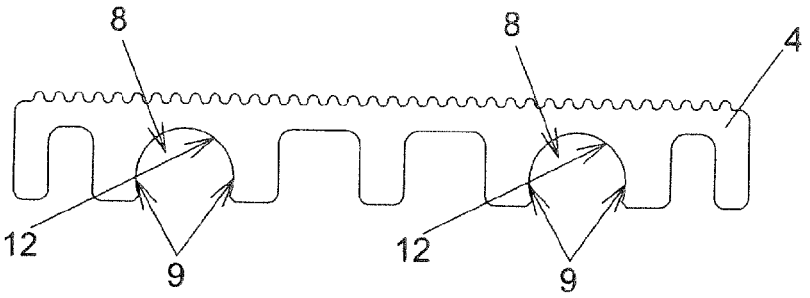
FIG. 5 further shows an exemplary covering element of the disclosed floor covering arrangement.

FIG. 5 once again shows an end-side view of a covering element 4, in this case in the form of a board, of the first exemplary embodiment. Once again, the rounded contour 12 of the latching receptacles 8 and the undercuts 9 can be easily seen here.

Figure 6:
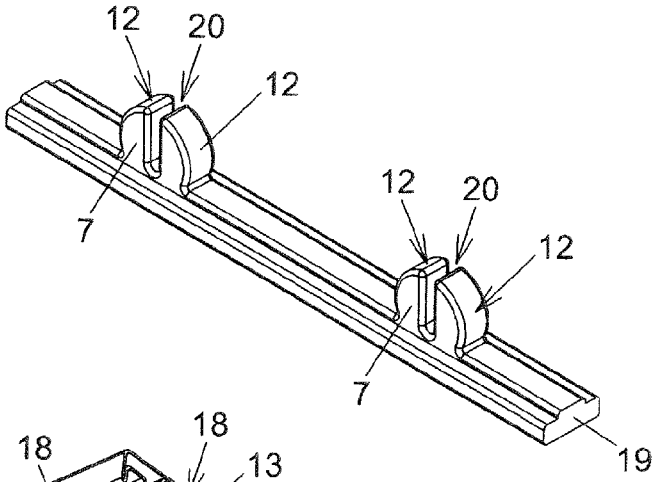
FIG. 6 further shows an exemplary carrier of the disclosed floor covering arrangement.
Figure 7:
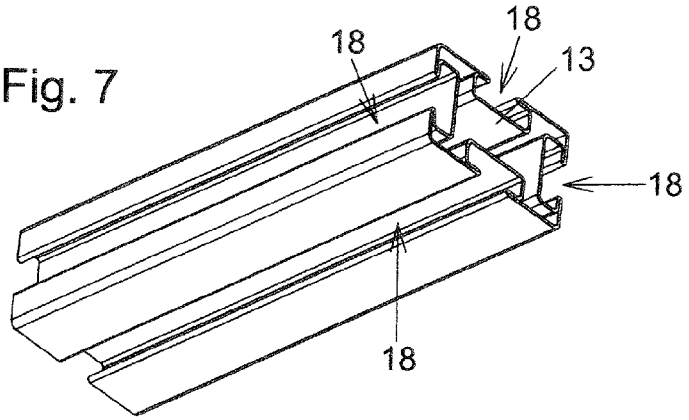
FIG. 7 further shows an exemplary profile rail of the disclosed floor covering arrangement.
Figure 8:
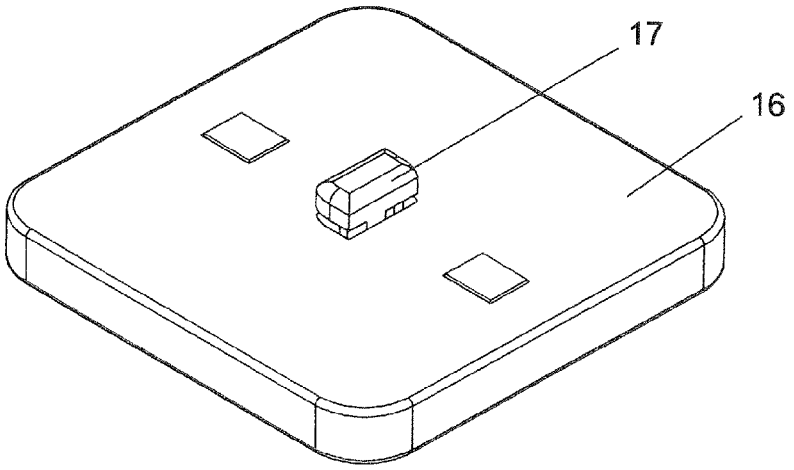
FIG. 8 further shows an exemplary bearing element part of the disclosed floor covering arrangement.

FIG. 6 shows a perspective illustration of a carrier 19 having two latching heads 7 integrally formed thereon. FIG. 7 shows a perspective illustration of a section of the profile rail 13 of the substructure 2. FIG. 8 shows the topmost bearing element part 16 of the bearing element 14 having the connecting head 17, which can engage in a form-fitting manner in an undercut groove 18 of the profile rail 13.

There are of course numerous alternatives to the exemplary embodiment, outlined by way of FIGS. 1 to 8, of an arrangement according to the invention having nondestructively detachable and re-connectable latching connections 3 for fastening the covering element 4 or the covering elements 4 to the substructure 2. In order to at least illustrate this, alternative embodiments are shown in FIGS. 9 and 10 in an illustration based on FIG. 4.

Figure 9:
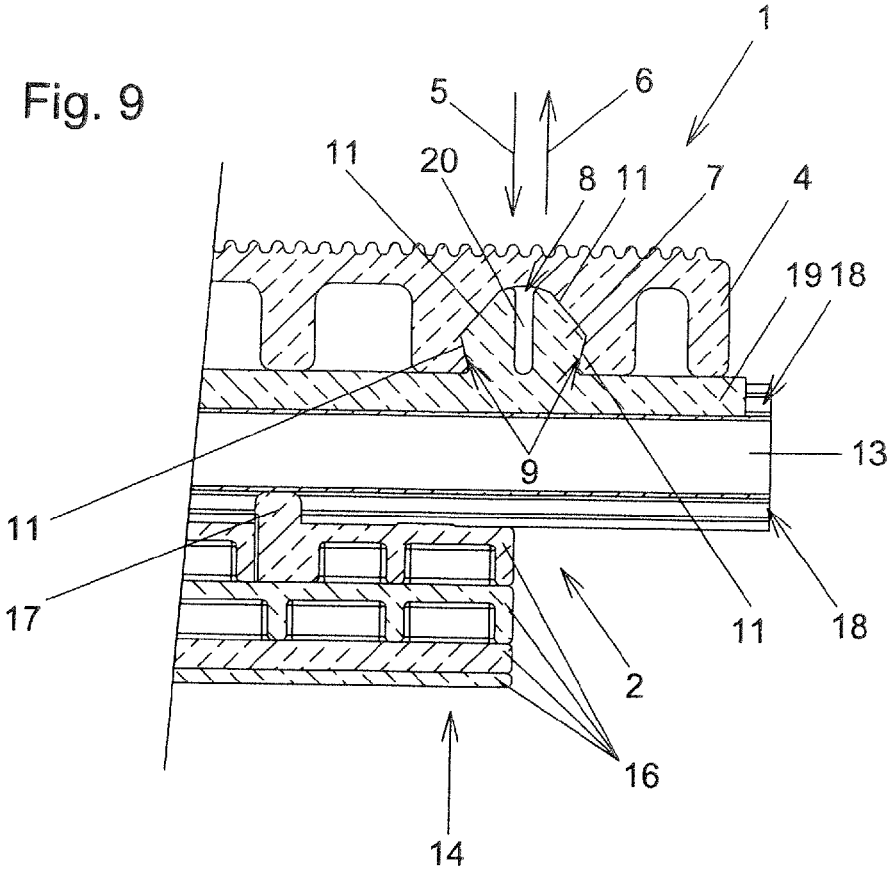
FIG. 9 shows a first alternative embodiment of a disclosed floor covering arrangement.
Figure 10:
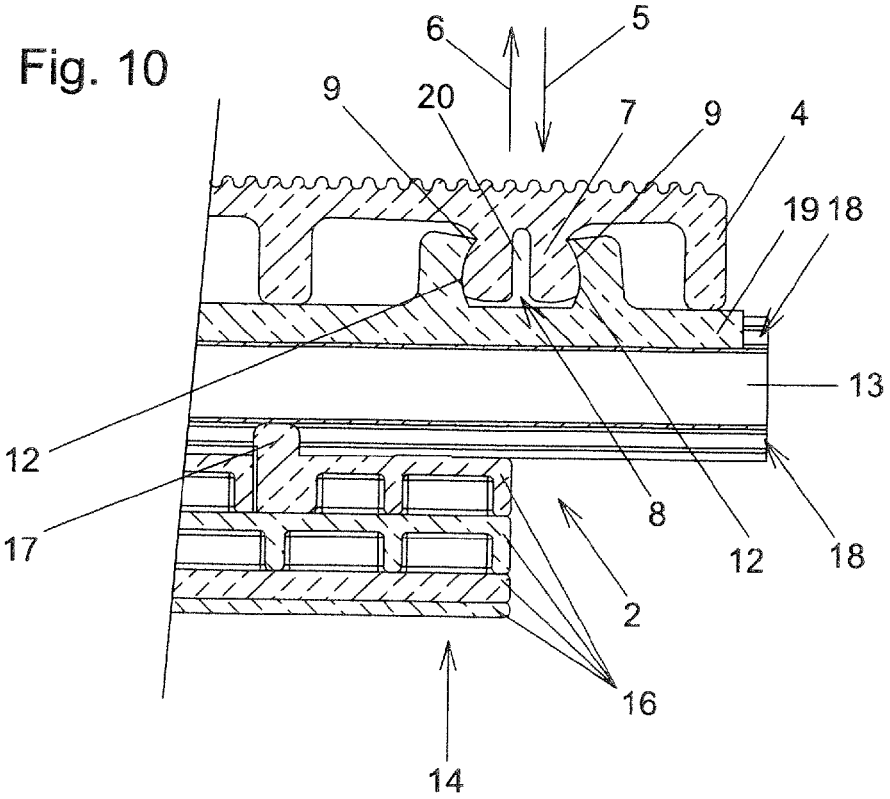
FIG. 10 shows a second alternative embodiment of a disclosed floor covering arrangement.

FIG. 9 shows a variant in which, for the purpose of a nondestructively detachable and re-connectable latching connection 3, the latching head 7 and the latching receptacle 8 do not have rounded contours 12 but inclined faces 11. These inclined faces 11 extend obliquely to the directions 5 and 6 in which pressing on takes place during engagement of the latching connection and lifting off takes place during disengagement of the latching connection. Whereas in the exemplary embodiments shown thus far the latching heads 7 have been fastened to the substructure 2 and the latching receptacles 8 to the covering elements 4, FIG. 10 shows one of many variants in which this is the other way round. In FIG. 10, the latching heads 7 are fastened, in this case integrally, to the covering element 4 while the latching receptacles 8 are fastened to the carrier 19 and thus to the substructure 2. In general, it should also be noted that of course the latching heads 7 can also be embodied as components that are longitudinally extended in a direction 10 and the latching receptacles 8 can be formed so as to be shorter than the latching heads 7 in the direction of this longitudinal extent. As mentioned at the beginning, quite different types of latching connections, for example magnetic connections or the like, can also be provided in that the relevant, mutually corresponding components are located on the one hand on the substructure 2 and on the other hand on the covering element 4.

Figure 11:
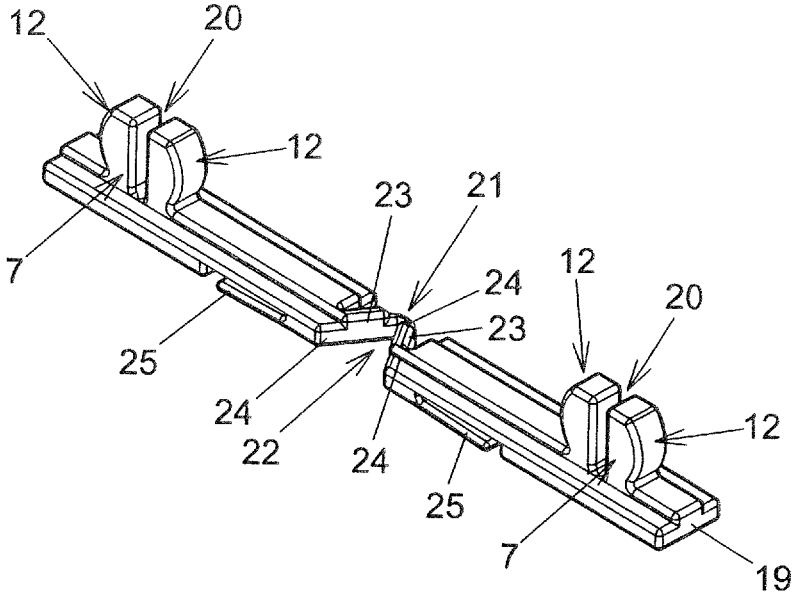
FIG. 11 shows an alternative preferred embodiment of a carrier having two latching heads.
Figure 12:
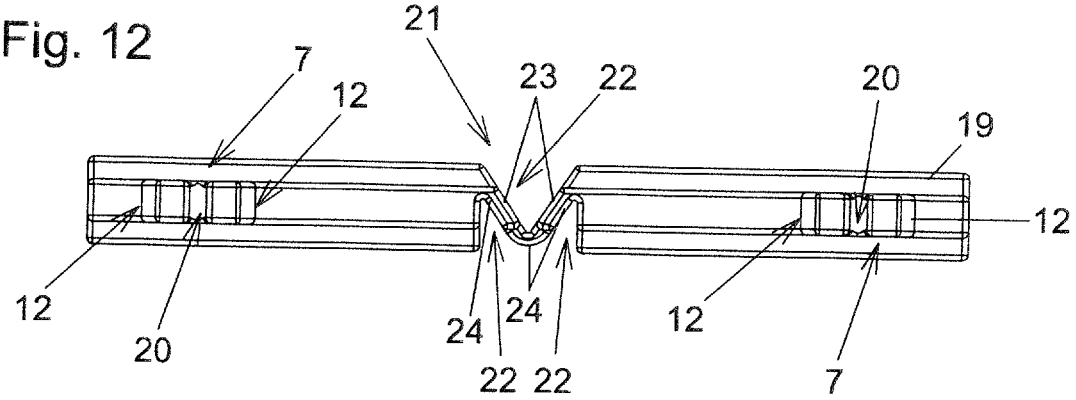
FIG. 12 shows a top view of the carrier of FIG. 11.
Figure 13:
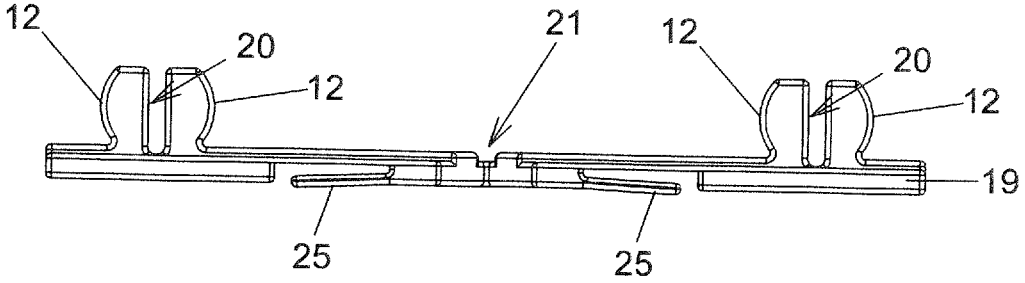
FIG. 13 shows a side view of the carrier of FIG. 11.

FIGS. 11 to 13 now show an alternative embodiment to FIG. 6 of a carrier 19 having two parts in each case of a latching connection 3. These parts of the latching connections 3 are arranged in a manner spaced apart from one another on the common carrier 19, as is also the case in FIG. 6. In the specific example, the parts of the latching connections 3 are two latching heads 7. Of course, these can also be replaced by latching receptacles 8 or other parts of suitable latching connections 3. It is of course also possible for more than two parts in each case of one latching connection 3 to be arranged on a common carrier 19. The carrier 19 of the exemplary embodiment according to FIGS. 11 to 13 can, like the carrier 19 according to FIG. 6, be arranged in or on a profile rail 13 of the substructure 2 so as to be displaceable along the profile rail 13. Preferably, to this end, it is guided in an undercut groove 18 of the profile rail 13. In contrast to the variant according to FIG. 6, the preferred embodiment according to FIGS. 11 to 13 has a carrier 19 having a compensation region 21. By means of this compensation region 21, a change in the spacing between the parts of the latching connections 3, thus in this case between the two latching heads 7, is allowed. A corresponding compensation region 21 could just as easily be arranged between at least one part of the latching connections 3, thus in this case at least one of the latching heads 7, and the carrier 19. These could be for example sliding connections between two sections of the carrier 19 or between the carrier 19 and at least one of the parts of the latching connections 3. In the specific exemplary embodiment, the compensation region 21 in the carrier 19 is formed as a thinning of material 22. Here, provision is made, in the specifically shown variant, of two bending limbs 23 that are arranged in a V-shaped manner with respect to one another, said bending limbs 23 being connected together or to the rest of the carrier 19 by means of bending joints 24. The compensation region 21 can be elastically deformable, but does not have to be. The main aim thereof is, as stated, that a for example moisture- or temperature-related change in the length and/or width of a covering element 4 and/or a change in the orientation of at least two covering elements 4 relative to one another as a result of a change in the spacing between the at least two parts of the latching connections 3 can be compensated. As a result, stresses, cracks or other damage in the covering elements 4 are avoided between the covering elements 4 and between the covering elements 4 and the substructure 2. The structure of the example realized here of the compensation region 21 can be seen particularly well in the perspective view according to FIG. 11 and in the plan view according to FIG. 12. The pretensioning elements 25 provided here on the carrier 19 can be seen particularly clearly in the side view according to FIG. 13. These pretensioning elements 25 are in the form of spring tongues in the specific exemplary embodiment. These pretensioning elements pretension the carrier 19 in the undercut groove 18 of the profile rail 13 such that the carrier 19, together with the respective parts of the latching connections 3, can be pushed into the undercut groove 18 only counter to a degree of frictional resistance, thereby, as already explained at the beginning, making it easier to assemble the covering elements 4 on the substructure 2.

KEY TO THE REFERENCE NUMERALS

1 Floor covering
2 Substructure
3 Latching connection
4 Covering element
5 Direction
6 Direction
7 Latching head
8 Latching receptacle
9 Undercut
10 Direction
11 Inclined face
12 Rounded contour
13 Profile rail
14 Bearing element
15 Connecting plate
16 Bearing element part
17 Connecting head
18 Undercut groove
19 Carrier
20 Gap
21 Compensation region
22 Thinning of material
23 Bending limb
24 Bending joint
25 Pretensioning element

The invention claimed is:

1. An arrangement for forming a floor, wall, or ceiling covering, comprising a substructure, at least one covering element fastened to the substructure by a latching connection, the latching connection configured as a nondestructively detachable and re-connectable latching connection in order to allow removal of the at least one covering element from the substructure and subsequent re-fastening of the at least one covering element to the substructure, wherein the latching connection is configured to nondestructively engage the at least one covering element when the at least one covering element is pressed against the substructure in a direction toward the substructure, and nondestructively disengage the at least one covering element when the at least one covering element is lifted from the substructure in a direction perpendicular to and away from the substructure, wherein the latching connection includes at least one latching head and at least one latching receptacle, each of said at least one latching head engaging in a form-fitting manner behind at least one undercut in a respective one of said at least one latching receptacle in an engaged state of the latching connection, wherein the substructure has at least one profile rail in or on which each of said at least one latching head or each of said at least one latching receptacle is arranged, and wherein each of said at least one latching head or each of said at least one latching receptacle is arranged to be displaceable along the profile rail.

2. The arrangement as claimed in claim 1, wherein each said latching receptacle comprises a longitudinally extended groove.

3. The arrangement as claimed in claim 2, wherein each said latching head is shorter than each said latching receptacle in a direction of longitudinal extent of a respective said latching receptacle.

4. The arrangement as claimed in claim 1, wherein at least one of each said latching head or each said latching receptacle has at least one of inclined faces or rounded contours to allow easier engagement, disengagement, or both of the latching connection.

5. The arrangement as claimed in claim 1, wherein at least one of each said latching head or each said latching receptacle are elastically deformable in order to allow engagement, disengagement, or both of the latching connection.

6. The arrangement as claimed in claim 1, wherein at least one of each said latching head or each said latching receptacle have at least regionally, in at least one cross section, a contour which is rounded and extends through an angular range of more than 180°.

7. The arrangement as claimed in claim 6, wherein the contour is circular.

8. The arrangement as claimed in claim 1, wherein the latching connection includes two parts, and in each case one part of at least two of the latching connections is arranged on a common carrier and said ones of the parts of the latching connections are spaced apart from one another.

9. The arrangement as claimed in claim 8, wherein the carrier is arranged in or on a profile rail of the at least one profile rail of the substructure so as to be displaceable along the profile rail.

10. The arrangement as claimed in claim 9, wherein the carrier is arranged in an undercut groove of the at least one profile rail.

11. The arrangement as claimed in claim 8, wherein a compensation region for changing a spacing between said ones of the parts of the latching connections is arranged in the carrier or between the carrier and said ones of the parts of the latching connections.

12. The arrangement as claimed in claim 8, wherein the two parts of the latching connections are latching heads or latching receptacles.

13. The arrangement as claimed in claim 1, wherein each said latching head or each said latching receptacle is arranged on a carrier, wherein at least one pretensioning element is provided on the carrier, wherein each said pretensioning element pretensions the carrier in an undercut groove of the profile rail such that the carrier can be pushed into the undercut groove only counter to a degree of frictional resistance.

14. The arrangement as claimed in claim 13, wherein the pretensioning element is a spring tongue.

15. A method for compensating for changes in at least one of a length or a width of a covering element or an orientation of at least two covering elements relative to one another in an arrangement as claimed in claim 11, the method comprising varying a spacing between the parts of the latching connections in the compensation region.

16. A method for the assembly of a floor, wall, or ceiling covering including the arrangement as claimed in claim 1, the method comprising nondestructively fastening the at least one covering element to the substructure in a detachable manner by engaging the latching connections.

17. An arrangement for forming a floor, wall, or ceiling covering, comprising a substructure, at least one covering element fastened to the substructure by a latching connection, the latching connection configured as a nondestructively detachable and re-connectable latching connection in order to allow removal of the at least one covering element from the substructure and subsequent re-fastening of the at least one covering element to the substructure, wherein the latching connection includes at least one latching head and at least one latching receptacle, the at least one latching head engaging in a form-fitting manner behind at least one undercut in the at least one latching receptacle in an engaged state of the latching connection, wherein the substructure has at least one profile rail in or on which the latching head or the latching receptacle is arranged, wherein the at least one latching head or the at least one latching receptacle is arranged to be displaceable along the profile rail, and wherein the at least one latching head or the at least one latching receptacle is arranged on a carrier, wherein at least one pretensioning element is provided on the carrier, wherein the at least one pretensioning element pretensions the carrier in an undercut groove of the profile rail such that the carrier can be pushed into the undercut groove only counter to a degree of frictional resistance.

* * * * *